US009089724B2

(12) United States Patent
Fenton et al.

(10) Patent No.: US 9,089,724 B2
(45) Date of Patent: Jul. 28, 2015

(54) MIST GENERATING APPARATUS

(75) Inventors: Marcus Brian Mayhall Fenton, Cambridgeshire (GB); James Oliver French, Cambridgeshire (GB)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 1391 days.

(21) Appl. No.: 12/741,995

(22) PCT Filed: Nov. 7, 2008

(86) PCT No.: PCT/GB2008/051040

§ 371 (c)(1),
(2), (4) Date: Jul. 27, 2011

(87) PCT Pub. No.: WO2009/060240

PCT Pub. Date: May 14, 2009

(65) Prior Publication Data

US 2012/0018531 A1 Jan. 26, 2012

(30) Foreign Application Priority Data

Nov. 9, 2007 (GB) ..... 0721995.9
Mar. 31, 2008 (GB) ..... 0805791.1
Apr. 4, 2008 (GB) ..... 0806182.2

(51) Int. Cl.
*B05B 1/26* (2006.01)
*A62C 31/05* (2006.01)
(Continued)

(52) U.S. Cl.
CPC ..... *A62C 5/008* (2013.01); *A62C 31/05* (2013.01); *A62C 99/0072* (2013.01); *B05B 1/262* (2013.01); *B05B 7/0815* (2013.01); *B05B 7/0853* (2013.01)

(58) Field of Classification Search
USPC ..... 169/14–15, 398, 433, 434, 434.5; 261/DIG. 26; 239/398, 419.3, 422–423, 239/428, 433, 434, 434.5
See application file for complete search history.

(56) References Cited

U.S. PATENT DOCUMENTS 3,644,076 A * 2/1972 Bagge ..... 431/284
4,145,000 A * 3/1979 Smith et al. ..... 239/14.2
(Continued)

FOREIGN PATENT DOCUMENTS

CN 201 366 386 12/2009
DE 201 18 801 U1 6/2002
(Continued)

OTHER PUBLICATIONS

International Searching Authority, International Search Report and Written Opinion issued in International Application No. PCT/GB2008/051040, Mar. 20, 2009, 8 pages.
(Continued)

*Primary Examiner* — Justin Jonaitis
(74) *Attorney, Agent, or Firm* — Perkins Coie LLP

(57) ABSTRACT

A mist generating apparatus is provided. The apparatus has a longitudinal axis and comprises first and second opposing surfaces which define a transport fluid nozzle between them. The apparatus also has a working fluid passage having a supply passage connectable to a supply of working fluid, and an outlet on one of the first and second surfaces. The working fluid outlet communicates with the transport fluid nozzle. The transport fluid nozzle has a nozzle inlet connectable to a supply of transport fluid, a nozzle outlet, and a throat portion intermediate the nozzle inlet and nozzle outlet. The nozzle throat has a cross sectional area which is less than that of either the nozzle inlet or the nozzle outlet. The transport fluid nozzle projects radially from the longitudinal axis such that the nozzle defines a rotational angle of at least 5 degrees about the longitudinal axis. A method of generating a mist using the apparatus is also provided.

28 Claims, 6 Drawing Sheets

(51) Int. Cl.

| | |
|---|---|
| ***A62C 5/00*** | (2006.01) |
| ***A62C 99/00*** | (2010.01) |
| ***B05B 7/08*** | (2006.01) |

(56) References Cited

U.S. PATENT DOCUMENTS

| | | | | |
|---|---|---|---|---|
| 4,383,646 | A * | 5/1983 | Smith | 239/14.2 |
| 5,495,893 | A * | 3/1996 | Roberts et al. | 169/37 |
| 5,575,341 | A * | 11/1996 | Baker et al. | 169/70 |
| 6,039,269 | A | 3/2000 | Mandzukic | |
| 6,098,897 | A * | 8/2000 | Lockwood | 239/8 |
| 6,763,894 | B2 * | 7/2004 | Schoenrock et al. | 169/47 |
| 2002/0125015 | A1 | 9/2002 | Crabtree | |
| 2004/0188104 | A1 * | 9/2004 | Borisov et al. | 169/62 |
| 2007/0210186 | A1 | 9/2007 | Fenton et al. | |
| 2008/0230632 | A1 | 9/2008 | Fenton et al. | |
| 2009/0314500 | A1 | 12/2009 | Fenton et al. | |
| 2010/0230119 | A1 | 9/2010 | Worthy et al. | |
| 2010/0301129 | A1 | 12/2010 | Fenton et al. | |
| 2011/0127347 | A1 | 6/2011 | Worthy et al. | |
| 2011/0203813 | A1 | 8/2011 | Fenton et al. | |

FOREIGN PATENT DOCUMENTS

| | | | | |
|---|---|---|---|---|
| EP | 1421996 | A | 5/2004 | |
| WO | WO 2005/123263 | | 12/2005 | |
| WO | WO 2005123263 | A1 * | 12/2005 | B05B 1/26 |

OTHER PUBLICATIONS

International Searching Authority, International Preliminary Report on Patentability issued in International Application No. PCT/GB2008/051040, Dec. 16, 2010, 5 pages.

European Application No. EP2008846762.

Australian Application No. AU2008326234.

US Application No. 14/550,573 Co-Pending Related Application to U.S. Appl. No. 12/741,995.

U.S. Appl. No. 14/342,777 (now abandoned) Co-Pending Related Application to U.S. Appl. No. 12/741,995.

International Search Report and Written Opinion of PCT/GB2013/052108, Dec. 5, 2012, 9 pp.

International Preliminary Report of Patentability of PCT/GB2013/052108, Mar. 12, 2014, 6 pp.

* cited by examiner

MIST GENERATING APPARATUS

This application is a U.S. National Stage Application of International Application No. PCT/GB2008/051040, which was filed on Nov. 7, 2008, and which claims priority to Great Britain Application Nos. 0721995.9, 0805791.1, and 0806182.2, which were filed on Nov. 9, 2007, Mar. 31, 2008, and Apr. 4, 2008, respectively, all of which are incorporated by reference in their entireties as if recited in full herein.

The present invention is directed to the field of mist generating apparatus, which generate and spray a mist of droplets. The apparatus of the present invention is particularly, although not exclusively, suited for use in cooling, fire suppression and decontamination applications.

Mist generating apparatus are known which inject a high-velocity transport fluid into a working fluid in order to atomise the working fluid and form a flow of dispersed working fluid droplets in a continuous vapour phase, which is then sprayed into the atmosphere. In such apparatus the working fluid is sprayed from a nozzle in a single general direction. As these existing apparatus only spray in a single direction, the spray angle of the droplets, that is the angle at which the spray of droplets initially leaves the apparatus, will be limited. Whilst such apparatus are very effective at covering an area directly in front of the nozzle with a mist, they are relatively inefficient if required to fill a given volume with a mist, such as would be required if the apparatus was deployed as part of a fire suppression system in a room in a building, for example. The apparatus would fill the volume with mist, but would require relatively large amounts of transport and working fluid to do so.

Therefore, one object of the present invention is to overcome the aforementioned disadvantage(s).

According to a first aspect of the invention, there is provided a mist generating apparatus having a longitudinal axis and comprising:

- first and second opposing surfaces which define a transport fluid nozzle therebetween; and
- a working fluid passage having an inlet connectable to a supply of working fluid, and an outlet on one of the first and second surfaces, the outlet communicating with the transport fluid nozzle;
- wherein the transport fluid nozzle has a nozzle inlet connectable to a supply of transport fluid, a nozzle outlet, and a throat portion intermediate the nozzle inlet and nozzle outlet, wherein the nozzle throat has a cross sectional area which is less than that of either the nozzle inlet or the nozzle outlet; and
- wherein the transport fluid nozzle projects radially from the longitudinal axis such that the nozzle defines a rotational angle about the longitudinal axis.

The term "working fluid" is used herein to describe the fluid which is to be sprayed from the mist-generating apparatus. Non-limiting examples of a suitable working fluid are water, a liquid fire retardant, or a liquid decontamination agent. The term "transport fluid" is used herein to describe the fluid which is introduced into the mist-generating apparatus in order to generate the mist of working fluid. The transport fluid is preferably a compressible gas. Non-limiting examples of a suitable transport fluid are compressed air, nitrogen, steam or carbon dioxide.

The apparatus may further comprise a transport fluid passage in fluid communication with the transport fluid nozzle inlet and connectable with the supply of transport fluid, wherein the transport fluid passage is parallel, and preferably coaxial, with the longitudinal axis.

The nozzle may define a rotational angle of at least 5 degrees about the longitudinal axis. The nozzle may define a rotational angle of at least 90 degrees about the longitudinal axis. In other words, the nozzle may define a rotational angle of between 5 and 360 degrees, or between 90 and 360 degrees, about the longitudinal axis. The nozzle may also define a rotational angle of between 90 and 180 degrees, between 180 and 270 degrees, or between 270 and 360 degrees about the longitudinal axis.

The nozzle may define a rotational angle of substantially 360 degrees about the longitudinal axis.

The nozzle outlet may comprise a slot in an external surface of the apparatus.

The nozzle outlet may be continuous around a portion of the perimeter of the apparatus covered by the rotational angle. The apparatus may further comprise one or more filler members which may be inserted into the nozzle outlet to create a discontinuity therein.

Alternatively, the nozzle outlet may be discontinuous around a portion of the perimeter of the apparatus covered by the rotational angle, such that the apparatus comprises a plurality of nozzle outlets.

The working fluid outlet may be open into the transport fluid nozzle intermediate the nozzle throat and the nozzle outlet.

The working fluid outlet may be on the first surface of the apparatus. The outlet may be substantially annular and coaxial with the longitudinal axis.

The working fluid passage may have a pair of outlets on the first surface of the apparatus. The outlets may be annular and concentric.

The apparatus may further comprise a second working fluid passage, the second working fluid passage having an inlet connectable to a supply of working fluid, and an outlet on the second surface of the apparatus, the outlet opening into the transport fluid nozzle intermediate the nozzle throat and the nozzle outlet. The outlet of the second passage may be substantially annular and coaxial with the longitudinal axis.

The second working fluid passage may have a pair of outlets on the second surface of the apparatus. The outlets of the second working fluid passage may be annular and concentric with one another.

The apparatus may further comprise first and second body members, wherein the first and second surfaces are provided on the first and second members, respectively.

The second member may be at least partially received in the first member, wherein the transport fluid supply passage is defined between the first and second members.

The first member may comprise a proximal end defining the first surface, and a bore extending longitudinally through the first member, and the second member may comprise a longitudinally extending shaft and a flange which defines the second surface projecting radially outwardly from one end of the shaft, wherein the shaft is located in the bore at the proximal end of the first member such that the first and second surfaces define the transport fluid nozzle between them.

The transport fluid passage may be defined between the exterior of the shaft and the wall of the bore.

The position of the second member may be adjustable relative to the first member. The apparatus may further comprise at least one adjuster which can adjust the position of the second member relative to the first member, and hence the distance between the first and second surfaces. The adjuster may project from the second surface onto the first surface, and may be adjusted to vary the amount by which it projects from the second surface. The apparatus may comprise a plurality of such adjusters.

The working fluid passage may be located within the first member.

The second working fluid passage may be located within the second member.

The first and/or second surfaces may be provided with one or more turbulence enhancers. The turbulence enhancers may comprise protrusions and/or indentations on the, or each, surface.

According to a second aspect of the present invention, there is provided a method of generating a mist with a mist generating apparatus having a longitudinal axis, the method comprising:

supplying a flow of transport fluid to a transport fluid nozzle defined between first and second opposing surfaces of the apparatus, the nozzle comprising a nozzle inlet, a nozzle outlet, and a nozzle throat intermediate the nozzle inlet and nozzle outlet, and the nozzle throat having a cross sectional area which is less than that of either the nozzle inlet or nozzle outlet;

supplying a working fluid from a working fluid outlet on one of the first and second surfaces to the transport fluid nozzle intermediate the nozzle throat and nozzle outlet;

accelerating the flow of transport fluid as it passes through the nozzle throat, whereby the accelerated transport fluid applies a shearing force to the working fluid that atomises the working fluid to form a mist of vapour and working fluid droplets; and spraying the mist from the nozzle radially of the longitudinal axis, such that the spray of mist has a rotational spray angle about the longitudinal axis as it leaves the nozzle outlet.

The transport fluid may be supplied to the transport fluid nozzle by a transport fluid passage which is coaxial with the longitudinal axis of the apparatus.

The mist may have a rotational spray angle about the longitudinal axis of at least 5 degrees as it leaves the nozzle outlet. The mist may have a rotational spray angle about the longitudinal axis of at least 90 degrees as it leaves the nozzle outlet.

The mist may have a rotational spray angle about the longitudinal axis of substantially 360 degrees as it leaves the nozzle outlet.

The nozzle outlet may be continuous around the perimeter of the apparatus, and the method may comprise an initial step of inserting one or more filler members into the nozzle outlet to form discontinuities therein.

The nozzle outlet may be discontinuous around the perimeter of the apparatus, and the method may comprise the step of spraying the mist from a plurality of nozzle outlets such that the spray of mist has a cumulative rotational spray angle about the longitudinal axis of at least 90 degrees as it leaves the nozzle outlets. The cumulative rotational spray angle about the longitudinal axis may be substantially 360 degrees as it leaves the nozzle outlets.

The working fluid may be supplied from a pair of working fluid outlets on the first surface into the transport fluid nozzle intermediate the nozzle throat and nozzle outlet.

The working fluid outlet may be on the first surface, and the method may further comprise supplying working fluid from a second working fluid outlet on the second surface to the nozzle intermediate the nozzle throat and the nozzle outlet. The working fluid may be supplied from a pair of second working fluid outlets on the second surface.

The working fluid supplied from the first and second working fluid outlets may be the same fluid. Alternatively, the method may comprise supplying first and second working fluids from the first and second working fluid outlets, respectively.

Supplying the working fluid from the working fluid outlets may comprise pumping the working fluid from the working fluid outlets.

The method may further comprise the step of adjusting the position of the second surface relative to the first surface, thereby adjusting the dimensions of the transport fluid nozzle.

According to a third aspect of the invention, there is provided a method for preventing, controlling, or extinguishing a fire within a space, the method comprising a method of generating a mist according to the second aspect of the invention, and further comprising spraying the mist into the space in an amount and for a period of time sufficient to prevent, control, or extinguish the fire.

According to a fourth aspect of the invention, there is provided a system for preventing, controlling, or extinguishing a fire within a space, the system comprising a mist generating apparatus according to the first aspect of the invention.

Preferred embodiments of the present invention will now be described, by way of example only, with reference to the accompanying drawings, in which.

Figure 1:
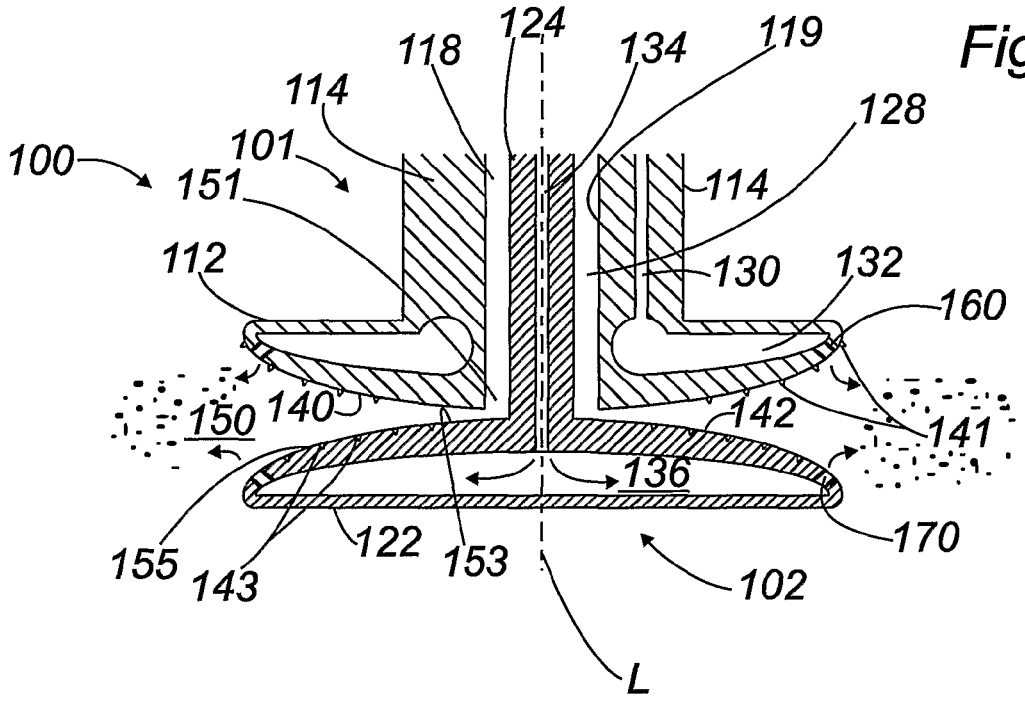
FIG. 1 shows a vertical section through a first embodiment of a mist generating apparatus.

FIG. 1 shows a first embodiment of a mist generating apparatus, generally designated 100 and having a longitudinal axis L. The apparatus is adapted to produce a substantially annular mist or spray pattern of atomised droplets over a rotational angle of between 5 and 360 degrees, and comprises a first member 101 and a second member 102.

The first member 101 has a generally cylindrical body 114 which has a first end connected to a supply of working fluid (not shown) and a second end having a first flange, or disc, 112 projecting radially outwardly therefrom. The body 114 defines a first working fluid supply passage 130 which is in fluid communication with the working fluid supply. The body 114 also includes a central bore 118, which extends through the body 114 in a direction generally parallel with the first working supply passage 130. The first disc 112 defines a first working fluid passage 132 which is generally perpendicular to, and in fluid communication with, the first working fluid supply passage 130, which also provides a first working fluid inlet. A first working fluid outlet 160 is provided at the remote end of the first working fluid passage 132 so that working fluid may pass from the first working fluid passage 132 through the outer surface 140 of the first disc 112. The first working fluid outlet 160 has a reduced cross-sectional area compared to the first working fluid passage 132. In the illustrated embodiment, both the first working fluid passage 132 and first working fluid outlet 160 extend about the entire perimeter of the first disc 112, such that both the passage 132 and outlet 160 form annuli in the first member 101 parallel, and preferably coaxial, with the longitudinal axis L.

The second member 102 has a longitudinally extending shaft 124 having a first end connected to a supply of working fluid (not shown) and a second end having a second flange, or disc 122, projecting radially outwardly therefrom. During assembly, the shaft 124 is received in the bore 118 such that the wall 119 of the bore 118 and the exterior of the shaft 124 define a transport fluid passage 128 between them.

The shaft 124 has a second working fluid supply passage 134 which is connected to a working fluid supply. The second working fluid supply passage 134 is generally parallel to the first working fluid supply passage 130 and the transport fluid passage 128. The second disc 122 defines a second working fluid passage 136 which is generally perpendicular to, and in fluid communication with, the second working fluid supply passage 134. A second working fluid outlet 170 is provided at the remote end of the second working fluid passage 136 so that working fluid may pass from the second working fluid passage 136 through the outer surface 142 of the second disc 122. The second working fluid outlet 170 has a reduced cross-sectional area compared to the second working fluid passage 136. The second working fluid outlet 170 is oriented such that working fluid will pass out of the outlet in the general direction of the first disc 112 and first working fluid outlet 160. In the illustrated embodiment, both the second working fluid passage 136 and second working fluid outlet 170 extend about the entire perimeter of the second disc 122, such that the outlet 170 forms an annulus in the second member 102 parallel, and preferably coaxial, with the longitudinal axis L.

With the shaft 124 inserted into the bore 118 of the first member 101, the first and second discs 112,122 are brought into close proximity. With the first and second discs 112,122 close to one another, their respective first and second surfaces 140,142 define a transport fluid nozzle 150 having a convergent-divergent inner geometry. By convergent-divergent geometry, it is meant that the nozzle 150 has a nozzle inlet 151 and a nozzle outlet 155, and a throat portion 153 intermediate the nozzle inlet 151 and nozzle outlet 155 which has a reduced cross-sectional area when compared with that of the inlet 151 and outlet 155. When viewed from outside the apparatus the nozzle outlet 155 forms a slot on the external surface of the apparatus. The nozzle 150 is in fluid communication with the transport fluid passage 128 to receive transport fluid therefrom. The nozzle 150 projects radially from the longitudinal axis L such that the nozzle 150 defines a rotational angle about the longitudinal axis L. Preferably, the rotational angle is at least 5 degrees, and preferably at least 90 degrees about the longitudinal axis L. Most preferably, the rotational angle of the nozzle is substantially 360 degrees about the longitudinal axis L. "Substantially 360 degrees" should be understood to encompass a rotational angle lying in the range of 355 to 360 degrees.

It is preferable that the position of the second member 102 can be adjusted relative to the first member 101, and that this is achieved by varying the extent to which the shaft 124 is axially inserted into the bore 118. This adjustment varies the distance between the first and second surfaces 140,142 of the discs 112,122, and consequently the internal geometry of the nozzle 150. The first and second surfaces 140,142 may include protrusions 141 extending from the respective surface and/or indentations 143 in the respective surface.

The method of operation of the apparatus shown in FIG. 1 will now be described. Initially, a working fluid—preferably water—is supplied from a working fluid supply to the first and second supply passages 130,134. The respective supply passages 130,134 may receive working fluid from the same supply, or else separate supplies can be used for each passage 130,134. The separate supplies may supply different working fluids to the supply passages 130,134. The working fluid will pass from the supply passages 130,134 into the first and second working fluid passages 132,136, and from there to the respective working fluid outlets 160,170. As the outlets 160, 170 are preferably of a reduced cross-sectional area compared to their respective working fluid passages 132,136, there is a build up of pressure in the working fluid passages 132,136. This leads to a stream of working fluid being supplied through the outlets 160,170, preferably in the form of a thin sheet of working fluid.

A transport fluid—preferably compressed air or nitrogen—is supplied to the transport fluid passage 128 from a transport fluid supply, and will then pass through the transport fluid nozzle 150. As the transport fluid passes through the convergent-divergent geometry created by the nozzle inlet 151, throat portion 153 and nozzle outlet 155, it undergoes an acceleration which causes the transport fluid to accelerate through the throat 153 to a very high, preferably at least sonic, velocity.

As the high velocity transport fluid flows from the throat 153 towards the outlet 155, it comes into contact with the streams of working fluid exiting the working fluid outlets 160,170. As the two fluids come into contact an energy transfer takes place between the two, primarily as a result of mass and momentum transfer between the high velocity transport fluid and the relatively low velocity working fluid. A heat transfer between the high temperature transport fluid and lower temperature working fluid also forms part of the energy transfer between the two fluids. This energy transfer imparts a shearing force on the working fluid streams, leading to the atomisation of the working fluid streams. Atomisation is used herein to refer to the break up of the working fluid into small droplets. This atomisation leads to the creation of a dispersed droplet-vapour flow regime spraying from the apparatus 100 radially of the longitudinal axis L over a spray angle of between 5 and 360 degrees about the longitudinal axis. A dispersed droplet-vapour flow regime is used herein to describe a mist comprising a dispersed phase of working fluid droplets in a continuous vapour phase of transport fluid. By varying the relative positions of the first and second members 101,102, and consequently the distance between the surfaces 140,142, the acceleration and velocity of the transport fluid can be controlled such that the degree of atomisation of the working fluid can also be varied accordingly.

The atomisation of the working fluid is achieved using primary and secondary break-up mechanisms. The primary mechanism is the high shear force applied to the working fluid by the transport fluid, which forms ligaments at the boundary surface of the water. These ligaments are stripped from the surface and atomised into droplets. Two secondary break-up mechanisms further atomise the working fluid droplets produced by the primary break-up. These secondary mechanisms are a further shear force caused by the remaining differential between the relative velocities of the transport and working fluid streams, and the turbulent eddy break-up of the working fluid caused by the turbulent flow of the expanding transport fluid radially outwards of the nozzle throat. The turbulent flow is enhanced when the protrusions 141 and/or indentations 143 are provided on one or both of the first and second surfaces 140,142. The mist generated by the apparatus has a majority of droplets whose diameters are between 1 and 10 microns.

The nozzle outlet 155 extends around the entire perimeter of the apparatus 100 and the mist sprayed from the apparatus may exit the apparatus at a spray angle of substantially 360 degrees about the transport fluid passage 128. "Substantially 360 degrees" should be understood to encompass a spray angle lying in the range of 355 to 360 degrees.

The working fluid outlets 160,170 of the first embodiment of the present invention are shown in FIG. 1 to both be angled to direct their respective streams of working fluid downstream and away from the nozzle outlet 155. In this manner, the streams will collide and disrupt one another. This disruption of the working fluid streams augments and further improves the atomisation of the working fluid caused by the transport fluid exiting the nozzle outlet 155.

Figure 2:
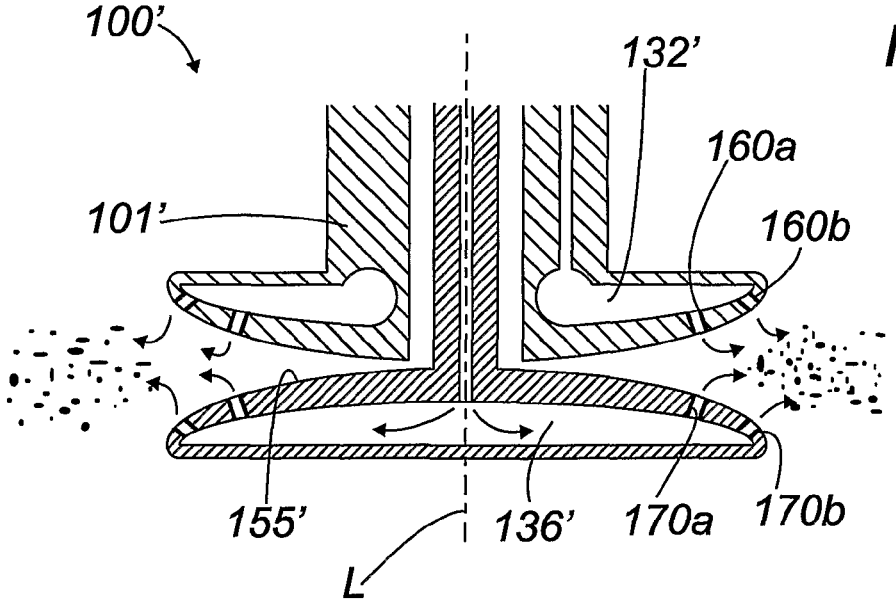
FIG. 2 shows a vertical section through a second embodiment of a mist generating apparatus.

Alternative arrangements of the working fluid outlets can also be incorporated into the present invention to further improve atomisation performance. A second preferred embodiment of the apparatus is shown in FIG. 2, and is generally designated 100'. The second embodiment is similar in form and function to the first embodiment, but includes one such alternative arrangement in which the first and second working fluid passages 132',136' each have a respective inner working fluid outlet 160*a*,170*a* and outer working fluid outlet 160*b*,170*b*. The inner and outer outlets form continuous or discontinuous concentric annuli about the first and second discs 112,122. As with the first embodiment, the pair of inner outlets 160*a*,170*a* and the pair of outer outlets 160*b*,170*b* are angled to direct their respective streams of working fluid downstream and away from the nozzle outlet 155'. In this manner, the streams from the inner outlets 160*a*,170*a* will collide and disrupt one another, as will the streams from the outer outlets 160*b*,170*b*. The arrangement of the second embodiment further improves the disruption of the working fluid streams that augments and further improves the atomisation of the working fluid by the transport fluid.

Figure 3:
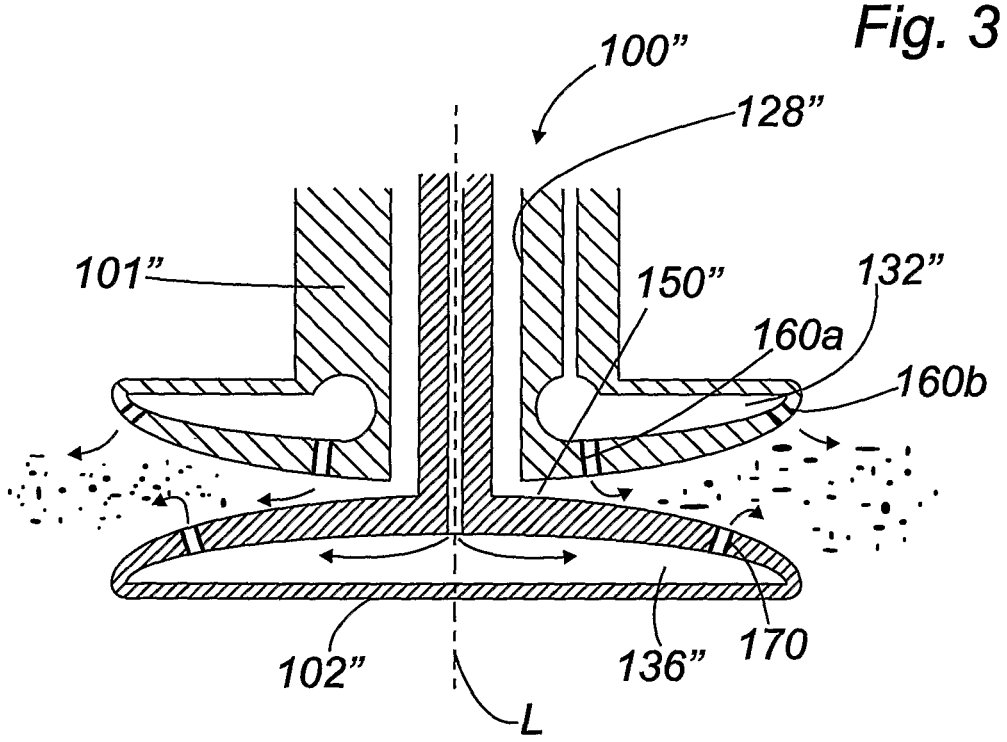
FIG. 3 shows a vertical section through a third embodiment of a mist generating apparatus.

In FIG. 3, a third embodiment of the apparatus, generally designated 100", is shown which employs a further alternative arrangement of working fluid outlets. This third embodiment is effectively a combination of components from the first and second embodiments, combining a first member 101" of the type used in the second embodiment with a second member 102" of the type used in the first embodiment. As a result, the first working fluid passage 132" has inner and outer working fluid outlets 160*a*,160*b* as with the second embodiment, but the second working fluid passage 136" located in the second member 102" has only a single working fluid outlet 170 as with the first embodiment. The working fluid outlets 160*a*,160*b* of the first member 101" and the working fluid outlet 170 of the second member 102" are positioned on their respective members such that they are preferably concentric with one another. In other words, the working fluid outlet 170 is positioned such that its annulus lies between those of the inner and outer working fluid outlets 160*a*,160*b* relative to the axial transport fluid passage 128". In this third embodiment, the working fluid streams issuing from the outlets 160*a*,160*b*,170 do not directly collide with one another, but instead create a degree of turbulence which disrupts each working fluid stream to further enhance the atomisation of the working fluid achieved by the transport fluid.

Figure 4:
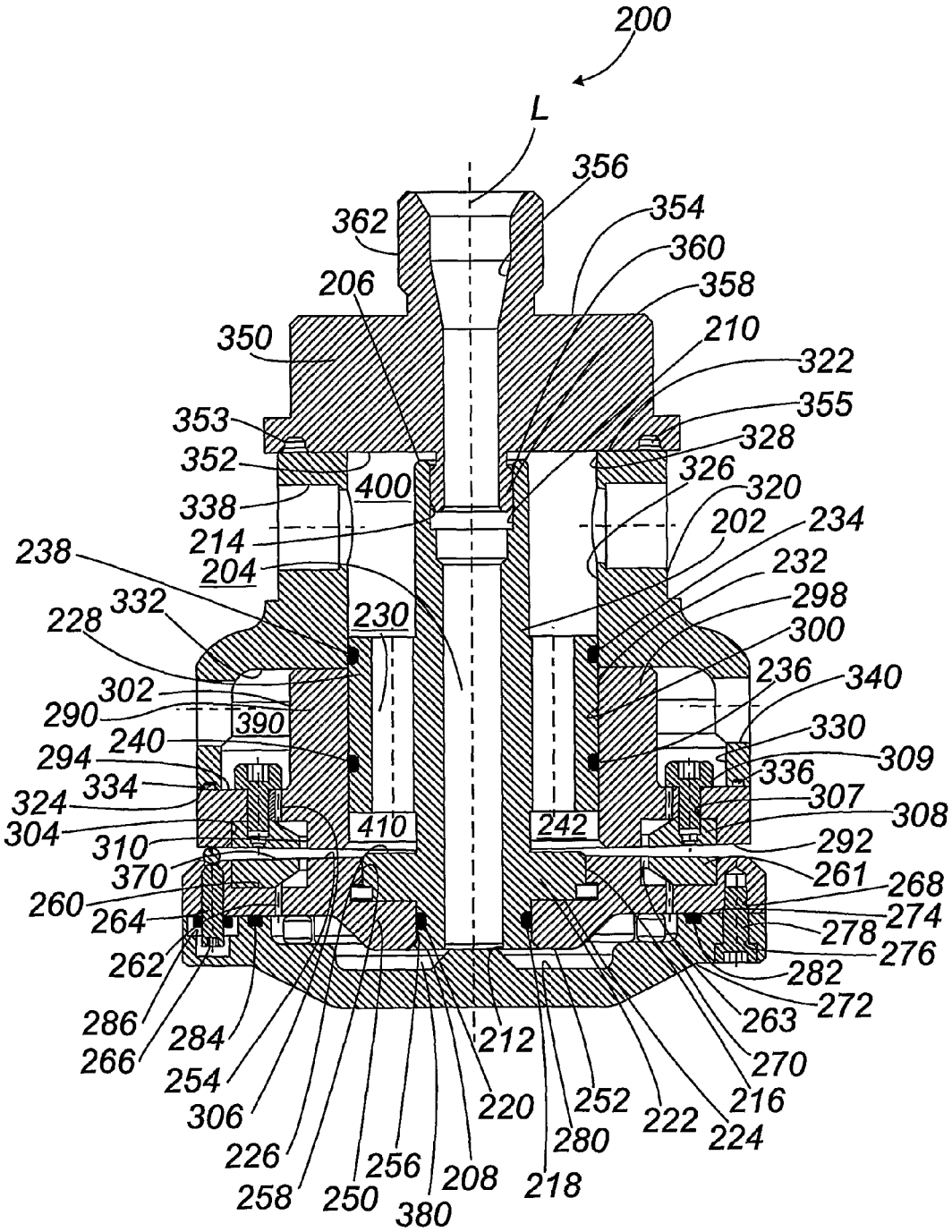
FIG. 4 shows a vertical section through a fourth embodiment of a mist generating apparatus.
Figure 5:
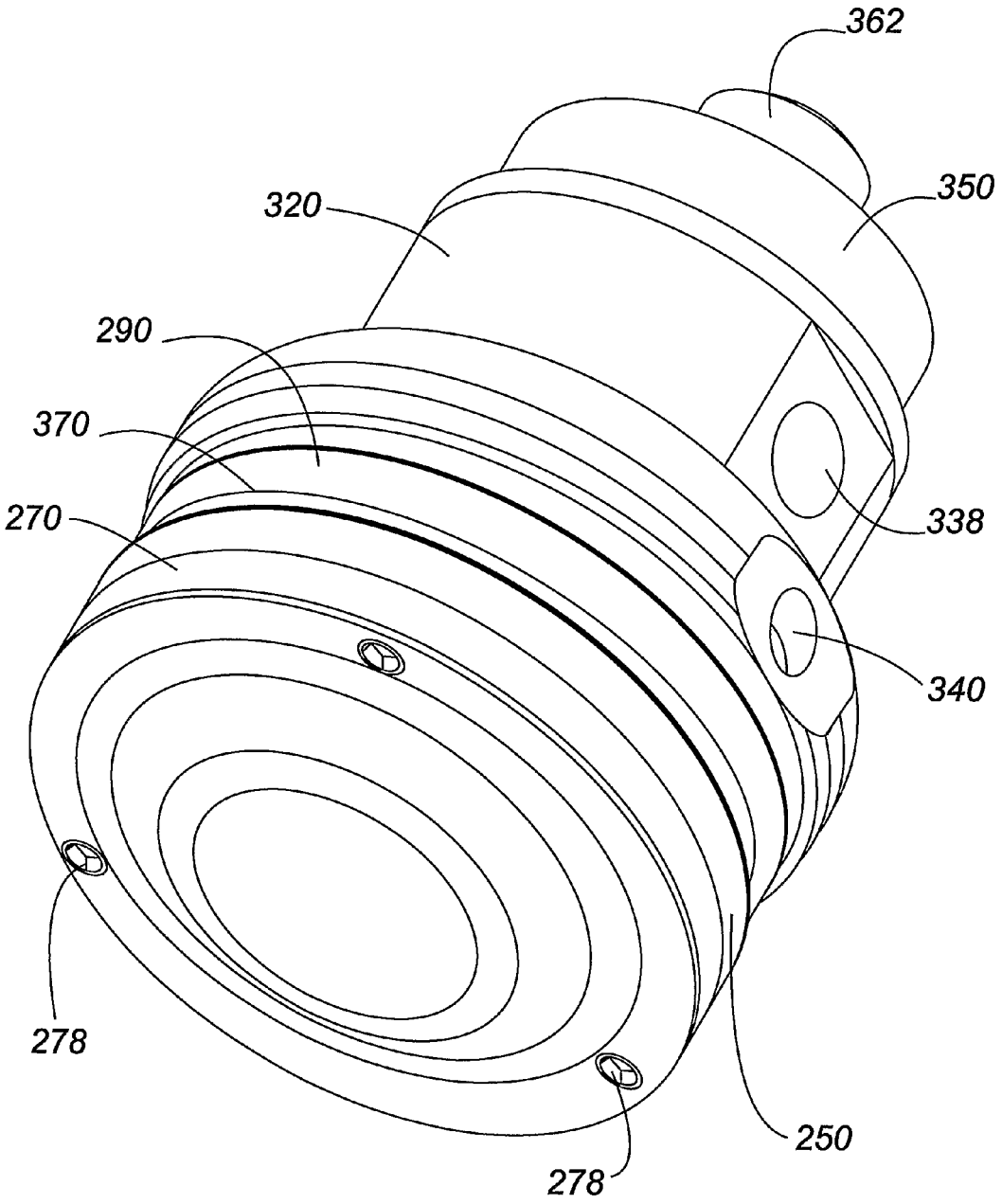
FIG. 5 shows a perspective view of the embodiment of the mist generating apparatus shown in FIG. 4.

A fourth embodiment of a mist generating apparatus according to the present invention is shown in FIGS. 4 and 5 and generally designated 200. The apparatus 200 has a longitudinal axis L and comprises a generally cylindrical shaft 202 having a primary passage 204 defined therein. The passage 204 extends longitudinally through the entire shaft 202 and is co-axial with the longitudinal axis L of the apparatus 200. The shaft 202 has a first end 206 and a second end 208, and the passage 204 has an inlet 210 and an outlet 212 at the respective first and second ends 206,208 of the shaft 202. A portion of the passage 204 adjacent the first end 206 has an inner thread 214. A groove 218 is also provided in the outer surface of the shaft 202 adjacent the second end 208. Within the groove 218 is located an O-ring seal 220.

The shaft 202 includes a flange portion 222 which adjoins the second end 208 and which projects radially from the longitudinal axis L. The flange portion 222 defines an abutment face 224 facing towards the second end 208 and a nozzle gap defining face 226 facing away from the second end 208. The outer surface of the flange portion 222 is provided with a threaded portion 216. The shaft 202 also includes a section 228 having an increased diameter compared to the remainder of the shaft 202. The increased diameter section 228 is located intermediate the first and second ends 206,208 of the shaft 202. Defined within the increased diameter section 228 are a number of secondary passages 230 which are substantially parallel to the primary passage 204 and are equidistantly spaced about the circumference of the shaft 202. The increased diameter section 228 has an external surface 232 in which two grooves 234,236 are defined, the grooves 234,236 being longitudinally spaced from one another. The grooves 234,236 each contain a respective O-ring seal 238,240. A free space 242 is defined between the increased diameter section 228 and the flange portion 222.

The apparatus 200 also includes a generally circular disc member 250. The disc 250 has a front face 252, a rear face 254, and a central aperture. The aperture has a smaller diameter portion 256 adjacent the front face 252 and a larger diameter portion 258 adjacent the rear face 254. The internal surface of the larger diameter portion 258 is threaded. The rear face 254 of the disc 250 has a first annular channel 260 extending around the central aperture. A plurality of small passages 262 extend through the disc 250 from the annular channel 260 to the front face 252. The passages 262 are equidistantly spaced about the disc 250 such that they surround the central aperture. Located in the annular channel 260 is an annular insert 261 formed from a material having good machining properties. In this preferred example, the insert 261 is made from brass. The insert 261 is fixed in the channel 260 by a number of threaded fixtures (not shown) which pass though holes provided in the disc 250 into threaded holes in the insert 261. When fixed in the channel 260, the insert 261 defines a first working fluid outlet in the form of an annular working fluid nozzle 263 opening onto the rear face 254 of the disc 250. The nozzle 263 is in fluid communication with the passages 262 such that fluid communication is possible between the front and rear faces 252,254 of the disc 250.

Spaced about the circumference of the disc 250 are a number of threaded adjustment apertures 264. Located in each adjustment aperture 264 is a threaded nozzle gap adjuster 266. One end of each nozzle gap adjuster 266 projects from the front face 252 of the disc 250, and is adapted to receive an adjustment tool (not shown). The other end of each nozzle gap adjuster 266 projects from the rear face 254 of the disc 250. A number of threaded fixing apertures 268 are also provided in the disc 250 for receiving fixing means, as will be described in more detail below.

The apparatus 200 also comprises a cap member 270. The cap 270 has an outer face 272 and an inner face 274. The outer face 272 has a number of apertures 276 which extend longitudinally through the cap 270 and which receive fixtures 278 therein. The inner face 274 has an annular channel 280 which surrounds the centre and longitudinal axis L of the cap 270. Also formed in the inner face 274 is an annular groove 282, within which is located an O-ring seal 284, and also a number of cavities 286 adapted to receive the heads of the nozzle gap adjusters 266 in the disc 250, as will be described below.

The apparatus 200 also includes a ring member 290 having a front face 292 and a rear face 294 and a central aperture.

Extending axially from the rear face 294 is an annular lip 298. The lip 298 has an inner surface 300 which defines the central aperture, and an outer surface 302. Formed in the front face 292 of the ring 290 is a second annular channel 304 extending around the central aperture of the ring 290. A plurality of small passages 306 extend through the ring 290 from the annular channel 304 to the rear face 294. The passages 306 are equidistantly spaced about the ring 290 such that they surround the central aperture. Located in the annular channel 304 is a second annular insert 308 which, as with the first annular insert 261, is formed from a material having good machining properties. In this preferred example, the insert 308 is made from brass. The ring 290 has a number of apertures 307 extending through it. Threaded fixtures 309 pass through the apertures 307 into threaded holes in the insert 308 to fix the insert 308 in position in the channel 304. Alternatively, other devices suitable for fixing the insert 308 in position may be used in place of the threaded fixtures 309. When located in the channel 304, the insert 308 defines a second working fluid outlet in the form of an annular working fluid nozzle 310 opening onto the front face 292 of the ring 290. The nozzle 310 is in fluid communication with the passages 306 such that fluid communication is possible between the front and rear faces 292,294 of the ring 290.

The penultimate component of the apparatus 200 is a cover member 320 having a first end 322 and a second end 324. The cover 320 is a generally cylindrical member having a passage 326 extending longitudinally therethrough. The passage 326 has a smaller diameter section 328 adjacent the first end 322 and a larger diameter section 330 adjacent the second end 324. Between them, the smaller diameter section 328 and the larger diameter section 330 of the passage 326 define an abutment face 332 facing in the direction of the second end 324. An annular groove 334 is provided in the second end 324 of the cover 320, in which an O-ring seal 336 is located. A pair of first supply passages 338 are provided diametrically opposite one another adjacent the first end 322 of the cover 320. The supply passages 338 are substantially perpendicular to the longitudinal axis L and allow fluid communication between the exterior of the cover 320 and the smaller diameter section 328 of the passage 326. A pair of second supply passages 340 are provided diametrically opposite one another adjacent the second end 324 of the cover 320. The supply passages 340 are also substantially perpendicular to the longitudinal axis L and allow fluid communication between the exterior of the cover 320 and the larger diameter section 330 of the passage 326.

The final component of the apparatus is a base member 350. The base 350 is generally circular and has a front face 352 and a rear face 354. A central passage 356 extends longitudinally through the base 350 and is co-axial with the longitudinal axis L. Projecting axially from the front face 352 is an annular front lip 358 which is co-axial with the passage 356. Formed in the front face 352 is an annular groove 353 in which is located an O-ring seal 355. The external surface 360 of the front lip 358 is threaded. Projecting axially from the rear face 354 of the base 350, in the opposite direction from the front lip 358, is a rear lip 362. The rear lip 362 is also annular and co-axial with the passage 356.

The manner in which the various components of the apparatus 200 are assembled will now be described. As described above, the first annular insert 261 is fixed into the first annular channel 260 in the disc member 250 by a number of fixtures (not shown). Between them, the insert 261 and channel 260 define a first working fluid outlet nozzle 263. Once fixed in position, the insert 261 is machined so that the exposed surface of the insert 261 is flush with the rear face 254 of the disc 250. An identical procedure takes place in respect of the ring member 290, wherein the second insert 308 is fixed in the second channel 304 by fixtures 309 so as to define a second working fluid outlet nozzle 310. As with the first insert 261, the second insert 308 is then machined so that the exposed surface of the insert 308 is flush with the front face 292 of the ring 290.

Once the inserts 261,308 have been machined, the disc 250 is threaded onto the flange portion 222 of the shaft 202 by way of their respective threaded portions 258 and 216 co-operating with one another. The disc 250 is threaded onto the shaft 202 until it comes into contact with the abutment face 224 of the flange portion 222. At the same time, the O-ring seal 220 ensures a sealing fit between the two components.

Following the assembly of the disc 250 to the second end 208 of the shaft 202, the ring member 290 is slid axially over the shaft 202 from the first end 206 such that the inner surface 300 of the ring 290 lies against the external surface 232 of the shaft 202. The O-ring seal 240 ensures a sealing fit between the ring 290 and shaft 202. The ring 290 slides over the body until its front face 292 comes into contact with the nozzle gap adjusters 266 projecting from the rear face 254 of the disc 250. Once contact is made with the nozzle gap adjusters 266, the front face 292 of the ring 290 and the rear face 254 of the disc 250 provide first and second opposing surfaces which define a transport fluid nozzle 370 between them. The thickness of both the disc 250 and ring 290 reduces in the radial direction. As a result, the nozzle 370 has a diverging profile, where the cross sectional area of the nozzle 370 is greater at any point radially outward of the inserts 261,308 than at any point radially inward of the inserts 261,308 up to and including the nozzle throat. The nozzle 370 projects radially from the longitudinal axis L of the apparatus and defines a rotational angle about the longitudinal axis L. The nozzle 370 preferably extends about the entire circumference of the apparatus 200, so as to define a rotational angle of substantially 360 degrees about the longitudinal axis L. "Substantially 360 degrees" should be understood to encompass a rotational angle lying in the range of 355 to 360 degrees. The respective annular working fluid nozzles 263,310 of the disc 250 and the ring 290 open into the transport fluid nozzle 370 approximately half way along the nozzle gap 370.

Once the ring 290 is in contact with the nozzle gap adjusters 266, the cover 320 can be slid onto the shaft 202 behind the ring 290. The cover 320 slides onto the shaft 202 with the external surface 232 of the shaft 202 acting as a guide surface for the internal surface of the cover 320 defined by the smaller diameter portion 328 of the passage 326. The cover 320 slides onto the shaft 202 until the abutment face 332 of the cover abuts the rear of the lip 298 extending rearwards from the ring 290. At the same time, the second end 324 of the cover 320 abuts the rear face 294 of the ring 290. Once in this position, the O-ring seals 238, 336 ensure a sealing fit between the cover 320 and the shaft 202, and the cover 320 and the ring 290, respectively.

In order to secure all the components in place, the base member 350 is then introduced onto the rear of the shaft 202. The front lip 358 of the base 350 is introduced into the inlet 210 of the passage 204, whereupon the external thread 360 of the front lip 358 co-operates with the internal thread 214 in the first end 206 of the shaft 202. The base 350 can then be screwed onto the first end 206 of the shaft 202. Once the base 350 is screwed in completely, its front face 352 abuts the first end 322 of the cover 320. This in turn axially locates the cover 320 against the ring 290, such that the base 350, cover 320, and ring 290 are all secured against one another. The shaft 202 is also secured to the base 350 by the threaded co-operation between the lip 358 and the first end 206 of the shaft 202. The shaft 202 therefore cannot move axially relative to the base 350, cover 320 or ring 290. The O-ring seal 355 ensures a sealing fit between the base 350 and the cover 320.

Figure 6:
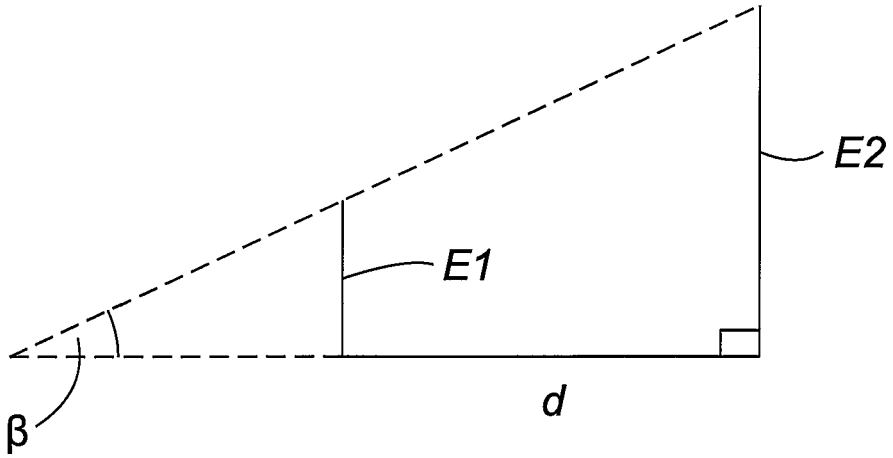
FIG. 6 is a schematic view of how the equivalent angle of expansion of a nozzle of a mist generating apparatus is calculated.

The nozzle 370 is checked using pin gauges or similar measuring instruments to determine whether it has suitable dimensions. These dimensions may provide a preferred area ratio between the nozzle throat and the nozzle outlet—in other words the ratio between the cross sectional area of the nozzle at the outlet and the cross sectional area of the nozzle at the nozzle throat—of between 1:1 and 15:1. Most preferably, the area ratio is between 11:10 and 18:5 (the cross sectional area at the outlet is most preferably between 1.1 and 3.6 times larger than that of the throat). These area ratios will provide the nozzle with an equivalent angle of expansion between the throat and outlet of preferably between 0.5 and 40 degrees. Most preferably, the equivalent angle of expansion is between 1 and 13 degrees. FIG. 6 shows schematically how this equivalent angle of expansion $\gamma$ for the nozzle 370 can be calculated when the cross sectional areas of the throat and outlet, and the equivalent path distance between the throat and outlet are known. E1 is the radius of a circle having the same cross sectional area as the nozzle throat. E2 is the radius of a circle having the same cross sectional area as the nozzle outlet. The distance d is the equivalent path distance between the throat and the outlet. An angle $\beta$ is calculated by drawing a line through the top of E2 and E1 which intersects a continuation of the equivalent distance line d. This angle $\beta$ can either be measured from a scale drawing or else calculated from trigonometry using the radii E1,E2 and the distance d. The equivalent angle of expansion $\gamma$ for the nozzle 370 can then be calculated by multiplying the angle $\beta$ by a factor of two, where $\gamma=2\beta$.

If the current dimensions are not suitable, the base 350 can be loosened and the nozzle gap adjusters 266 adjusted using an adjustment tool in order to ensure the correct dimensions of the nozzle 370. Once adjustment has been completed, the cap 270 can be fixed to the front face 252 of the disc 250 using the plurality of threaded fixtures 278. Once the cap 270 is in place, the head of each nozzle gap adjuster 266 is located in a respective adjuster cavity 286 in the cap 270. As a result, the nozzle gap adjusters 266 cannot be accessed once the cap 270 is fixed in place.

Once the various components are secured together, a number of chambers and openings are defined between the various components. A first annular working fluid chamber 380 is defined by the annular channel 280 in the cap 270 and the front face 252 of the disc 250. The first working fluid chamber 380 communicates with both the outlet 212 of the passage 204 and each of the small passages 262 extending through the disc 250. A second annular working fluid chamber 390 is defined by the outer surface of the rearward projecting lip 298 of the ring 290, and the abutment face 332 and inner surface of the larger diameter section 330 of the cover 320. The second working fluid chamber 390 communicates with both of the second supply passages 340 in the cover 320 and each of the small passages 306 extending through the ring 290.

A first annular transport fluid chamber 400 is defined by the outer surface of the shaft 202, the inner surface of the smaller diameter section 328 of the passage 326 in the cover 320, and the front face 352 of the base 350. The transport fluid chamber 400 communicates with both of the first supply passages 338 in the cover 320 and each of the secondary passages 230 extending longitudinally through the shaft 202. With the various components in position, the free space 242 forms part of a second annular transport fluid chamber 410 defined by the flange 222 and larger diameter section 228 of the shaft 202 and the inner surface 300 of the rearward projecting lip 298 of the ring 290. The second transport fluid chamber 410 communicates with each of the secondary passages 230 in the shaft 202 and acts as a nozzle inlet for the nozzle 370 defined between the disc 250 and the ring 290.

The manner in which the apparatus of the fourth embodiment operates will now be described, with particular reference to FIG. 4. Initially, a first pressurised supply of working fluid (not shown) is connected to the inlet of the passage 356 in the base 350. The working fluid is preferably water, and is preferably supplied at a pressure in the range 0.5-12 bar. The working fluid passes through the passage 356 into the passage 204 of the shaft 202. From there, the working fluid exits the passage 204 via the outlet 212 and enters the first working fluid chamber 380. The working fluid leaves the working fluid chamber 380 via the small passages 262 and then passes into the first working fluid nozzle 263 defined between the channel 260 and the insert 261. The insert 261 is shaped so that the nozzle 263 has a smaller cross sectional area than that of the passage immediately upstream of the nozzle 263. As a result, the working fluid passing through the nozzle is accelerated as it exits the first working fluid nozzle 263 into the transport fluid nozzle 370, creating a thin ring of working fluid exiting the nozzle 263.

At the same time as the first working fluid supply is connected to the passage 356 of the base 350, a second pressurised working fluid supply is connected to the second supply passages 340. The second working fluid is also preferably water and preferably supplied at a pressure in the range 0.5-12 bar. Consequently, the second working fluid supply flows into the second working fluid chamber 390 via the second supply passages 340. From the second working fluid chamber 390, the working fluid passes through each of the small passages 306 in the ring 290. The second insert 308 and second channel 304 define the second working fluid nozzle 310 which receives working fluid from the small passages 306. As with the first insert 261, the second insert 308 is shaped so that the second working fluid nozzle 310 has a smaller cross sectional area than that of the passage immediately upstream of the nozzle 310. As a result, the working fluid passing through the second working fluid nozzle 310 is accelerated to form a thin sheet of working fluid which enters the transport fluid nozzle 370 substantially opposite the working fluid exiting the first working fluid nozzle 263.

As the first and second supplies of working fluid enter the apparatus 200, so does a supply of transport fluid. A transport fluid supply, preferably a pressurised gas supplied at a pressure in the range 3-15 bar, is connected to both of the first supply passages 338. Consequently, transport fluid enters the first transport fluid chamber 400. From there, it passes through each of the passages 230 in the shaft 202 before expanding into the second transport fluid chamber 410 acting as the transport fluid nozzle inlet.

As can be clearly seen in FIG. 4, the cross sectional area of the second transport fluid chamber 410 is significantly greater than that of the nozzle 370 immediately downstream thereof, as defined between the disc 250 and the ring 290. As described above, as the nozzle 370 extends in the radial direction towards the circumference of the apparatus, its cross sectional area increases again. As a result, a throat section of reduced cross sectional area is present in the nozzle 370 downstream of the nozzle inlet provided by the second transport fluid chamber 410. As the transport fluid passes from the second transport fluid chamber 410 into the nozzle 370, the reduced cross sectional area of the nozzle throat causes the transport fluid to undergo a significant acceleration. This acceleration causes the velocity of the transport fluid to significantly increase, preferably to at least sonic velocity and most preferably to a supersonic velocity depending on the parameters of the transport fluid supplied to the apparatus. The high velocity transport fluid then comes into contact with the twin supplies of working fluid exiting the first and second working fluid nozzles 263,310.

The apparatus is preferably configured such that the working fluid-transport fluid mass flow ratio is 4:1. In other words, four times as much working fluid by mass is supplied to the nozzle than transport fluid. As with the other embodiments described herein, an energy transfer takes place between the transport fluid and working fluid, primarily as a result of mass and momentum transfer between the high velocity transport fluid and the relatively low velocity working fluid. This energy transfer imparts a shearing force on the working fluid streams, leading to the atomisation of the working fluid streams. This atomisation leads to the formation of a mist of dispersed working fluid droplets in a continuous vapour phase spraying from the apparatus 200 radially of the longitudinal axis L over a rotational spray angle relative to the axis L. The rotational spray angle may be between 5 and 360 degrees. As the cross sectional area of the nozzle 370 steadily increases downstream of the nozzle throat, the transport fluid and atomised working fluid droplets accelerate as they pass along the nozzle gap. The stream of mist droplets exiting the nozzle 370 also diverges as it leaves the apparatus 200. This divergence of the mist droplets further improves the mist generation as it avoids the impinging and coalescing of the droplets into larger droplets as they leave the apparatus. Adjusting the nozzle gap adjusters 266 varies the relative positions of the disc 250 and the ring 290 and consequently the dimensions of the transport fluid nozzle 370 defined between them. Adjustment of the nozzle dimensions in this way can vary the velocity and/or flow rate of the transport fluid passing through the nozzle 370. Hence the degree of atomisation of the working fluid caused by the shear forces from the transport fluid injection can also be varied as this shear force will change as a result of changes to the velocity and/or flow rate of the transport fluid through the nozzle 370.

The apparatus and method of the present invention provide a mist of working fluid droplets that is generated by the atomisation of the working fluid by a transport fluid and then sprayed from the apparatus over a rotational angle about the longitudinal axis of the apparatus. Consequently, the present invention is more efficient at filling a closed volume with such a mist than existing mist generating apparatus, whether of the twin fluid type or not. Thanks to the atomisation mechanism employed and the arrangement of the nozzle to define a rotational angle about the longitudinal axis of the apparatus, the present invention will use less of the transport and working fluids to fill a given volume with mist. As the apparatus can produce a spray of mist over a rotational angle anywhere between 5 and 360 degrees, the present invention can spray the mist in all directions at the same time. Thus, the volume will be filled with mist more quickly and using less of the fluids than existing apparatus which employ single direction nozzles. By way of example, a test conducted by the applicant using the fourth embodiment of the apparatus of the present invention was found to fill a volume of 280 cu m with mist to a virtually dense condition in between 30 seconds and 1 minute. The test used the working fluid-transport fluid mass flow ratio of 4:1 as described above.

As briefly discussed above, the increase in cross sectional area downstream of the transport fluid nozzle throat offers improved atomisation. The transport fluid flow exiting the nozzle gap diverges, thereby reducing the likelihood of droplets impinging on one another and coalescing back into larger droplets, and thus ensuring that for the most part the atomised droplets remain separate.

The components of the fourth embodiment and their method of assembly also offer improvements in terms of working tolerances. Forming and assembling the components in the manner described above improves the accuracy of the relative axial and concentric positioning of the components. This ensures consistency of fit, particularly with reference to the dimensions of the transport fluid passages and chambers.

Referring to a material as having good machining properties is intended to describe a material, such as brass, which can be easily machined without creating burrs on the edges of the material. This is important in the case of the first and second inserts as it ensures that the insert can be machined flush with the respective disc or ring without any burring problems which could partially or fully block the working fluid nozzles defined by the inserts. The inserts of the present invention maintain a clean edge when machined.

The preferred location of the working fluid nozzles is intermediate the transport fluid nozzle throat and outlet in the radial direction. However, the working fluid nozzles may also be located upstream of the nozzle throat, or at the throat itself. Positioning the working fluid nozzles opposite one another in the nozzle gap leads to the working fluid sprays impinging on one another as they enter the nozzle gap. This further improves the atomisation mechanisms of the invention, but is not essential.

Whilst the illustrated fourth embodiment has first and second working fluid nozzles and associated supply passages, working fluid may also only be provided through one of the first and second working fluid nozzles. In such a case, the unused nozzle and passages can be left empty, or else the apparatus can be adapted to remove the redundant nozzle and passages.

As the nozzle of the apparatus of the present invention is defined between two opposing surfaces, the nozzle outlet is formed as a slot. Consequently, the mist leaves the nozzle outlet in a generally flat, or planar, spray pattern. As the nozzle outlet has a larger cross sectional area than the nozzle throat and is defined between these opposing surfaces, the nozzle has a fan-like geometry when viewed in plan. In other words, the nozzle defines a rotational angle about the longitudinal axis of the apparatus of between 5 and 360 degrees. This fan-like, or divergent, profile ensures that the spray of mist is diverging as it leaves the apparatus. In other words, the spray also has a spray angle of between 5 and 360 degrees and a fan-like shape as it leaves the apparatus. Once out of the nozzle outlet, the spray pattern loses its planar, fan-like form as the mist droplets now diverge in all directions as a result of the turbulence generated by the transport fluid. By ensuring that the spray diverges even before it leaves the nozzle outlet, this ensures that the droplets of the mist diverge from one another, and do not coalesce into larger droplets. Consequently, the majority of the droplets spraying from the apparatus have a diameter of between 1 and 10 microns.

The first and second surfaces which define the transport fluid nozzle of any of the aforementioned embodiments can include the protrusions and/or indentations provided in the first embodiment shown in FIG. 1 to further enhance the turbulence as the transport fluid atomises the working fluid.

Figure 7:
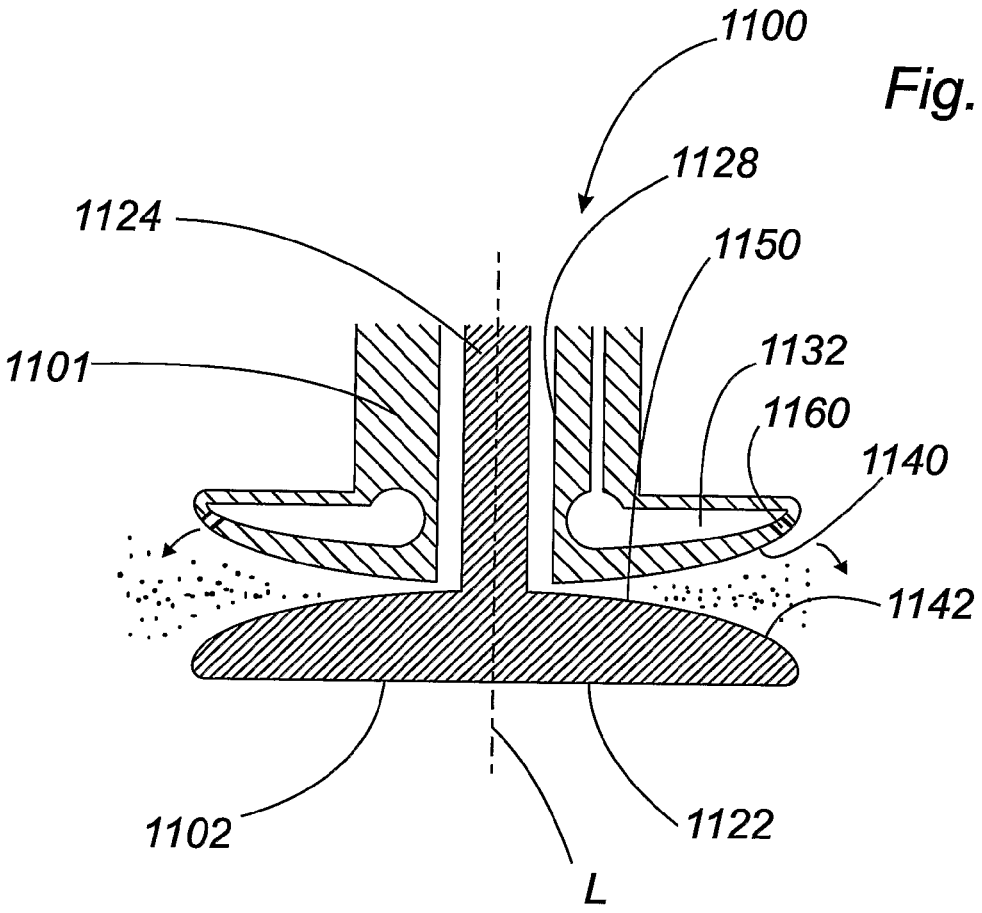
FIG. 7 shows a vertical section through a fifth embodiment of a mist generating apparatus.

Whilst the illustrated embodiments of the present invention all employ a second working fluid passage and second working fluid outlet(s) in the second member, it should be understood that the apparatus may also operate successfully with only one working fluid passage and outlet in the first member. A fifth embodiment of the apparatus 1100 shown in FIG. 7 shows such an arrangement. In this embodiment, a transport fluid nozzle 1150 is defined between the first and second outer surfaces 1140,1142 of first and second members 1101,1102. However, in this modified embodiment the disc 1122 and shaft 1124 of the second member 1102 are solid. The second outer surface 1142 on the disc 1122 still helps to define the transport fluid nozzle, but no working fluid is supplied from the second member 1102. Working fluid is only supplied from the working fluid passage 1132 and outlet 1160 into the transport fluid nozzle 1150, and transport fluid is supplied to the nozzle 1150 via the transport fluid passage 1128. The manner in which the working fluid is atomised is the same as in the preceding embodiments.

Some of the transport fluid nozzles are described in the embodiments above as preferably projecting radially from the longitudinal axis of the apparatus to define a spray angle about the axis of substantially 360 degrees. However, it should be appreciated that the transport fluid nozzles may be adapted to define any spray angle over 5 degrees about the longitudinal axis, and preferably any spray angle over 90 degrees about the longitudinal axis.

Furthermore, the transport fluid nozzle may extend discontinuously around the perimeter of the apparatus, either over a portion of the perimeter or the entire perimeter. Consequently, the apparatus may comprise a plurality of nozzle outlets.

The plurality of first working fluid outlets are each in fluid communication with a single first working fluid passage. Alternatively, a plurality of first working fluid passages may each be in fluid communication with a respective one of the plurality of first working fluid outlets.

The plurality of second working fluid outlets are each in fluid communication with a single second working fluid passage. Alternatively, a plurality of second working fluid passages may each be in fluid communication with a respective one of the plurality of second working fluid outlets.

The working fluid outlets may be provided with directional working fluid nozzles which can be adjusted to vary the angle at which the working fluid stream encounters the transport fluid.

Whilst the transport fluid nozzle outlet is preferably continuous and produces a rotational spray angle of 360 degrees about the longitudinal axis of the apparatus, it may be desirable to block selective portions of the nozzle by way of one or more filler members. For example, if locating a mist generating apparatus of the present invention in the corner of a room, filler members may be inserted between the first and second surfaces to block portions of the transport fluid nozzle outlet. This ensures that all of the mist is sprayed out into the room and none of the mist is wasted by being sprayed directly into the corner. The filler members may be shims inserted into the nozzle at the desired position.

The apparatus and method of the present invention may be incorporated into a respective system and method for preventing, controlling, or extinguishing a fire in a space. In such a case, the working fluid may be water or an alternative fire retardant fluid.

In the foregoing embodiments, the transport fluid used is preferably compressed air or nitrogen. However, it should be understood that other fluids may be used instead. For example, steam or carbon dioxide could be used in place of air or nitrogen.

The preferred supply pressure ranges of the working fluid and transport fluid, as well as the preferred mass flow ratio between the two, described with respect to the operation of the fourth embodiment of the present invention may equally be applied to the other embodiments of the invention described herein.

These and other modifications and improvements can be made without departing from the scope of the present invention.

The invention claimed is:

1. A mist generating apparatus having a longitudinal axis and comprising:

first and second opposing surfaces which define a transport fluid nozzle therebetween; and a working fluid passage having an inlet connectable to a supply of working fluid, and an annular outlet on one of the first and second surfaces, the outlet communicating with the transport fluid nozzle;

wherein the transport fluid nozzle has a nozzle inlet connectable to a supply of transport fluid, a nozzle outlet, and a throat portion intermediate the nozzle inlet and nozzle outlet, wherein the nozzle throat has a cross sectional area which is less than that of both the nozzle inlet or the nozzle outlet;

wherein the nozzle outlet defines a slot on an external surface of the mist generating apparatus;

wherein the working fluid outlet is substantially annular and concentric with the longitudinal axis; and wherein the transport fluid nozzle projects radially from the longitudinal axis such that the nozzle defines a rotational angle about the longitudinal axis so that a flow of transport fluid passes through the nozzle throat and accelerates the transport fluid to apply a shearing force to a working fluid in communication with the transport fluid nozzle from the working fluid outlet and atomises the working fluid to form a mist of vapour and working fluid droplets.

2. The apparatus of claim 1, further comprising a transport fluid passage in fluid communication with the transport fluid nozzle inlet and connectable with the supply of transport fluid, wherein the transport fluid passage is parallel with the longitudinal axis.

3. The apparatus of claim 2, wherein the transport fluid passage is coaxial with the longitudinal axis.

4. The apparatus of claim 1, wherein the nozzle defines a rotational angle of at least 90 degrees about the longitudinal axis.

5. The apparatus of claim 1, wherein the nozzle defines a rotational angle of substantially 360 degrees about the longitudinal axis.

6. The apparatus of claim 1, wherein the slot is continuous around a portion of the perimeter of the apparatus covered by the rotational angle.

7. The apparatus of claim 6, further comprising one or more filler members which may be inserted into the slot to create a discontinuity therein.

8. The apparatus of claim 1, wherein the slot is discontinuous around a portion of the perimeter of the apparatus covered by the rotational angle, such that the nozzle comprises a plurality of slots.

9. The apparatus of claim 1, wherein the working fluid outlet opens into the transport fluid nozzle intermediate the nozzle throat and the slot.

10. The apparatus of claim 1, wherein the working fluid outlet is on the first surface of the apparatus.

11. The apparatus of claim 10, wherein the working fluid outlet is coaxial with the longitudinal axis.

12. The apparatus of claim 10, wherein the working fluid passage has a pair of working fluid outlets on the first surface of the apparatus, and wherein the pair of working fluid outlets are annular and concentric with one another.

13. The apparatus of claim 10, further comprising a second working fluid passage, the second working fluid passage having an inlet connectable to a supply of working fluid, and an outlet on the second surface of the apparatus, the outlet opening into the transport fluid nozzle intermediate the nozzle throat and the slot.

14. The apparatus of claim 13, wherein the outlet of the second working fluid passage is substantially annular and coaxial with the longitudinal axis.

15. The apparatus of claim 13, wherein the second working fluid passage has a pair of outlets on the second surface of the apparatus, and wherein the pair of outlets of the second working fluid passage are annular and concentric with one another.

16. The apparatus of claim 1, further comprising first and second body members, wherein the first and second surfaces are provided on the first and second members, respectively, and the second member is at least partially received in the first member.

17. The apparatus of claim 16, wherein a position of the second member is adjustable relative to the first member, and the apparatus further comprises at least one adjuster which can adjust the position of the second member relative to the first member, and hence the distance between the first and second surfaces.

18. The apparatus of claim 17, wherein the adjuster projects from the second surface onto the first surface, and may be adjusted to vary the amount by which it projects from the second surface.

19. The apparatus of claim 1, wherein the first and/or second surface is provided with one or more turbulence enhancers.

20. A method of generating a mist with a mist with a mist generating apparatus having a longitudinal axis, the method comprising:

supplying a flow of transport fluid to a transport fluid nozzle defined between first and second opposing surfaces of the apparatus, the nozzle comprising a nozzle inlet, a nozzle outlet, and a nozzle throat intermediate the nozzle inlet and nozzle outlet, and the nozzle throat having a cross sectional area which is less than that of either the nozzle inlet or nozzle outlet;

supplying a thin sheet of working fluid from an annular working fluid outlet concentric with the longitudinal axis on one of the first and second surfaces to the transport fluid nozzle intermediate the nozzle throat and nozzle outlet;

accelerating the flow of transport fluid as it passes through the nozzle throat, whereby the accelerated transport fluid applies a shearing force to the working fluid that atomises the working fluid to form a mist of vapour and working fluid droplets; and spraying the mist from the nozzle radially of the longitudinal axis, such that the spray of mist has a rotational spray angle about the longitudinal axis as it leaves a slot on an external surface of the mist generating apparatus defined by the nozzle outlet.

21. The method of claim 20, wherein the mist has a rotational spray angle about the longitudinal axis of at least 90 degrees as it leaves the slot.

22. The method of claim 20, wherein the mist has a rotational spray angle about the longitudinal axis of substantially 360 degrees as it leaves the slot.

23. The method of claim 20, wherein the slot is continuous around a portion of the perimeter of the apparatus covered by the rotational angle, and the method comprises an initial step of inserting one or more filler members into the slot to form discontinuities therein.

24. The method of claim 20, wherein the slot is discontinuous around a portion of the perimeter of the apparatus covered by the rotational angle, and the method comprises the step of spraying the mist from a plurality of slots such that the spray of mist has a cumulative rotational spray angle about the longitudinal axis of at least 90 degrees as it leaves the slots.

25. The method of claim 24, wherein the cumulative rotational spray angle about the longitudinal axis is substantially 360 degrees as it leaves the slots.

26. The method of claim 20, wherein the working fluid is supplied from a pair of working fluid outlets on the first surface to the transport fluid nozzle intermediate the nozzle throat and slot.

27. The method of claim 20, wherein the working fluid outlet is on the first surface, and the method further comprises supplying working fluid from a second working fluid outlet on the second surface to the nozzle intermediate the nozzle throat and the slot.

28. The method of claim 20, further comprising the step of adjusting the position of the second surface relative to the first surface, thereby adjusting the dimensions of the transport fluid nozzle.

* * * * *